US008904680B1

(12) United States Patent
Trovillion

(10) Patent No.: US 8,904,680 B1
(45) Date of Patent: Dec. 9, 2014

(54) INTERIORIALLY ILLUMINATED RECONSTRUCTED WOODEN LOG AND METHODS OF MAKING

(71) Applicant: Jeffrey Scott Trovillion, Mesa, AZ (US)

(72) Inventor: Jeffrey Scott Trovillion, Mesa, AZ (US)

( * ) Notice: Subject to any disclaimer, the term of this patent is extended or adjusted under 35 U.S.C. 154(b) by 0 days.

(21) Appl. No.: 14/060,453

(22) Filed: Oct. 22, 2013

Related U.S. Application Data

(60) Provisional application No. 61/756,608, filed on Jan. 25, 2013.

(51) Int. Cl.

| | |
|---|---|
| ***G09F 19/00*** | (2006.01) |
| ***B27M 1/08*** | (2006.01) |
| ***B27M 3/00*** | (2006.01) |
| ***F21V 33/00*** | (2006.01) |
| ***G09F 13/04*** | (2006.01) |

(52) U.S. Cl.
CPC ..... *G09F 19/00* (2013.01); *B27M 1/08* (2013.01); *B27M 3/0013* (2013.01); *F21V 33/00* (2013.01); *G09F 13/04* (2013.01)
USPC ..... 40/428; 40/442

(58) Field of Classification Search
USPC ..... 40/442, 428
See application file for complete search history.

(56) References Cited

U.S. PATENT DOCUMENTS

| | | | | |
|---|---|---|---|---|
| 1,432,942 | A * | 10/1922 | Zei et al. | 40/428 |
| 1,590,083 | A * | 6/1926 | Collins | 40/428 |
| 1,827,941 | A * | 10/1931 | Gross | 40/428 |
| 8,413,358 | B2 * | 4/2013 | Betz et al. | 40/428 |

* cited by examiner

*Primary Examiner* — Gary Hoge
(74) *Attorney, Agent, or Firm* — Desandro Law Group PLLC; Bradley K. DeSandro

(57) ABSTRACT

A reconstructed wooden log has segments from the same log, each having opposing concentric arcuate ends and being fastened to adjacent segments with a spacer contacting effecting separation from each adjacent segment. A light source within a hollow interior defined by the arcuate interior ends emits light between the separations of the adjacent wood segments and around the spacers. Reconstruction of the original log includes separating the original log radially about its longitudinal axis into the segments, and removing a portion of each segment that was proximal the original log's longitudinal axis. The reconstructed log, having about the same length and width as that of the original log, can have electro-mechanics within and/or near its hollow interior to receive control signals and detect motion to initiate rotation of the log to reveal signage and other decorative embellishments illuminated by the light source, and/or render an audible report.

20 Claims, 5 Drawing Sheets

Fig. 3a
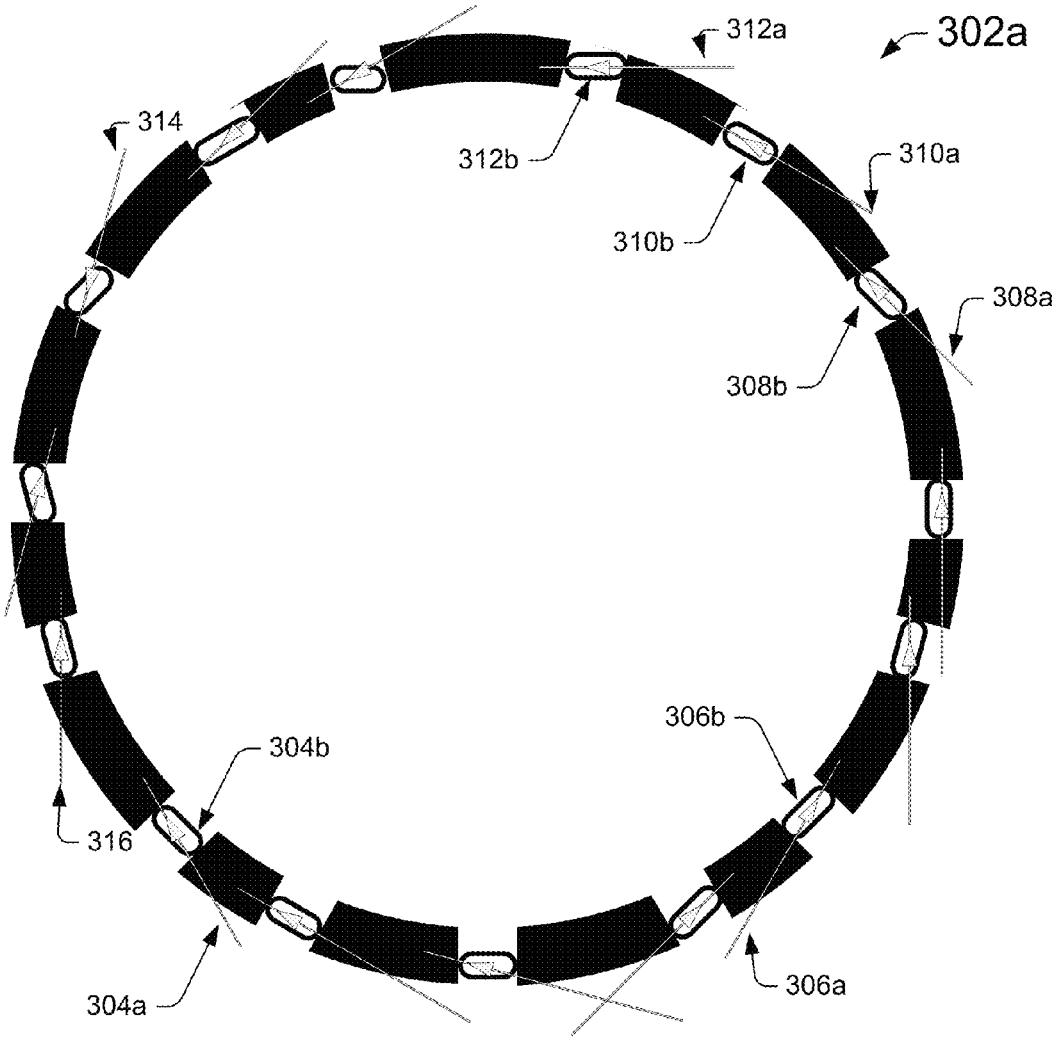
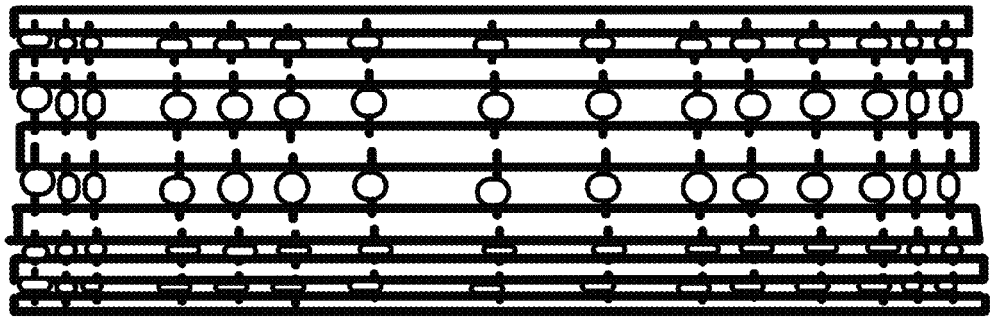
Fig. 3b
302b

Fig. 4a
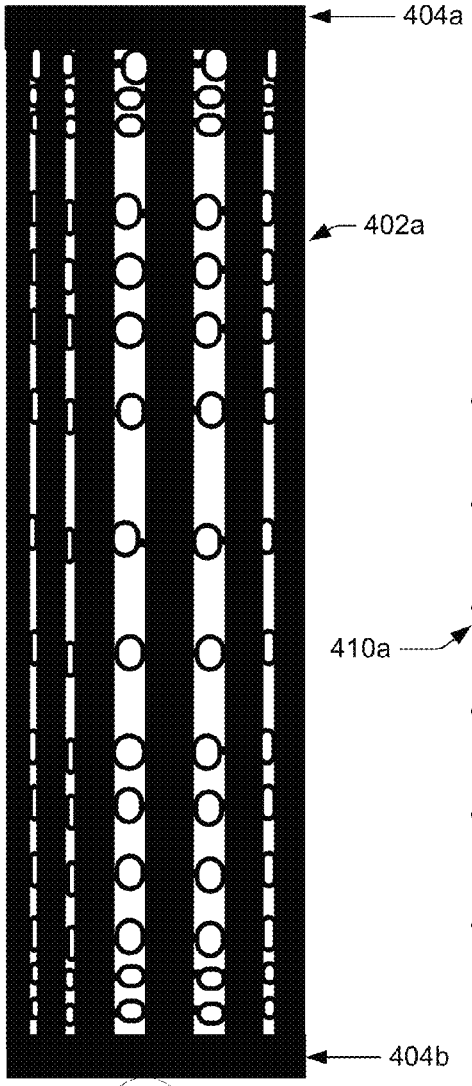
Fig. 4b
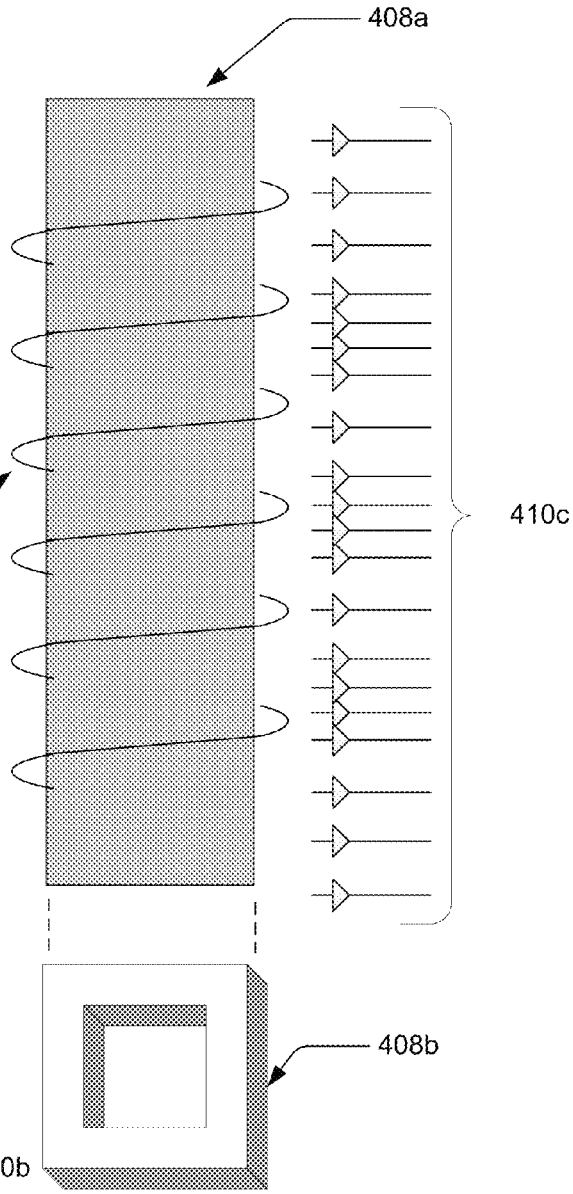
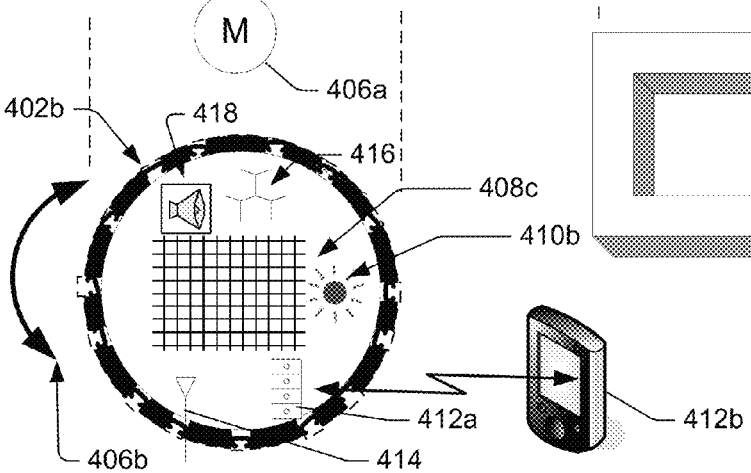
Fig. 4c

INTERIORIALLY ILLUMINATED RECONSTRUCTED WOODEN LOG AND METHODS OF MAKING

RELATED APPLICATIONS

This application claims priority to U.S. Provisional Application Ser. No. 61/756,608, titled "A reconstructed log that allows the interior lights to illuminate through spaces," filed on Jan. 25, 2013, which is incorporated herein by reference.

FIELD

Implementations generally relate to lighting, more particularly relate to a wooden lighting device, and most particularly relate to an interiorially illuminated reconstructed wooden log.

BACKGROUND

Devices providing ambient lighting for indoor and outdoor space, as well as for advertising and other signage, would attract more significant consumer interest if fashioned with a biomimetic aesthetic, such by mimicking a wooden log. As such, it would be an advance in the illumination arts to provide an interiorially illuminated reconstructed wooden log.

BRIEF DESCRIPTION OF THE DRAWINGS

FIGS. 3*a*-3*b* respective show cross sectional and longitudinal views of an exemplary reconstruction implementation for a deconstructed wooden log prepared by a processing implementation such as is shown in FIGS. 1*a*-1*b;*

FIGS. 4*a* and 4*c* respective show longitudinal and cross sectional views of an interiorially illuminated reconstructed wooden log prepared by an exemplary processing implementation such as is shown in FIGS. 1*a* though 3, the log having a plurality of electro-mechanical mechanisms to accomplish a plurality of functions to enhance and complement the log's lighting functionally including motion detected activated dynamic audio visual signage;

Implementations will become more apparent from the detailed description set forth below when taken in conjunction with the drawings, in which like elements bear like reference numerals.

DETAILED DESCRIPTION

Implementations relates to a method of reconstructing a wooden log that allows interior lights to illuminate through spaces in the reconstructed wood log. In one implementation, a plurality of spacers each has a fastener there through to secure adjacent segments of the reconstructed wooden log, where opposing ends of each segment are each secured to an end cap. The segments hewn from the original wooden log are secured with the fasteners and spacers to form the reconstructed wood log. The spacers, which are preferably at least partially transparent, provide openings between the segments through which light is emitted from one or more light sources inside the reconstructed wood log.

In some implementations, the interiorially illuminated reconstructed wooden log provides interior decorating accents. By way of example, and not by way of limitation, exemplary implementations include providing a shell or façade to cover or conceal: (i) a structural post or beam; (ii) a chase for electrical wiring; (ii) an image capture device such as a still or video camera; (iii) an audio rendering device such as a speaker; (iv) duct work such are used for heating, ventilation, and air conditioning; and (v) combinations of the foregoing.

In other implementations, the interiorially illuminated reconstructed wooden log is provisioned with a variety of electro-mechanical functionality. By way of example, and not by way of limitation, exemplary implementations include providing the interiorially illuminated reconstructed wooden log with a motion detection sensor, a motor to rotate the log so that one side of the log lacking signage is out of a viewing position to reveal an opposing side of the log having signage that is illuminated by a light source inside the reconstructed wooden log, where motion detected by the sensor activates the motor to rotate the log and to render an audio file from a speaker inside the log. Note that the wooden appearance of the side of the log that lacks signage acts as camouflage to the casual viewer whose motion is detected by the sensor.

Figure 1A:
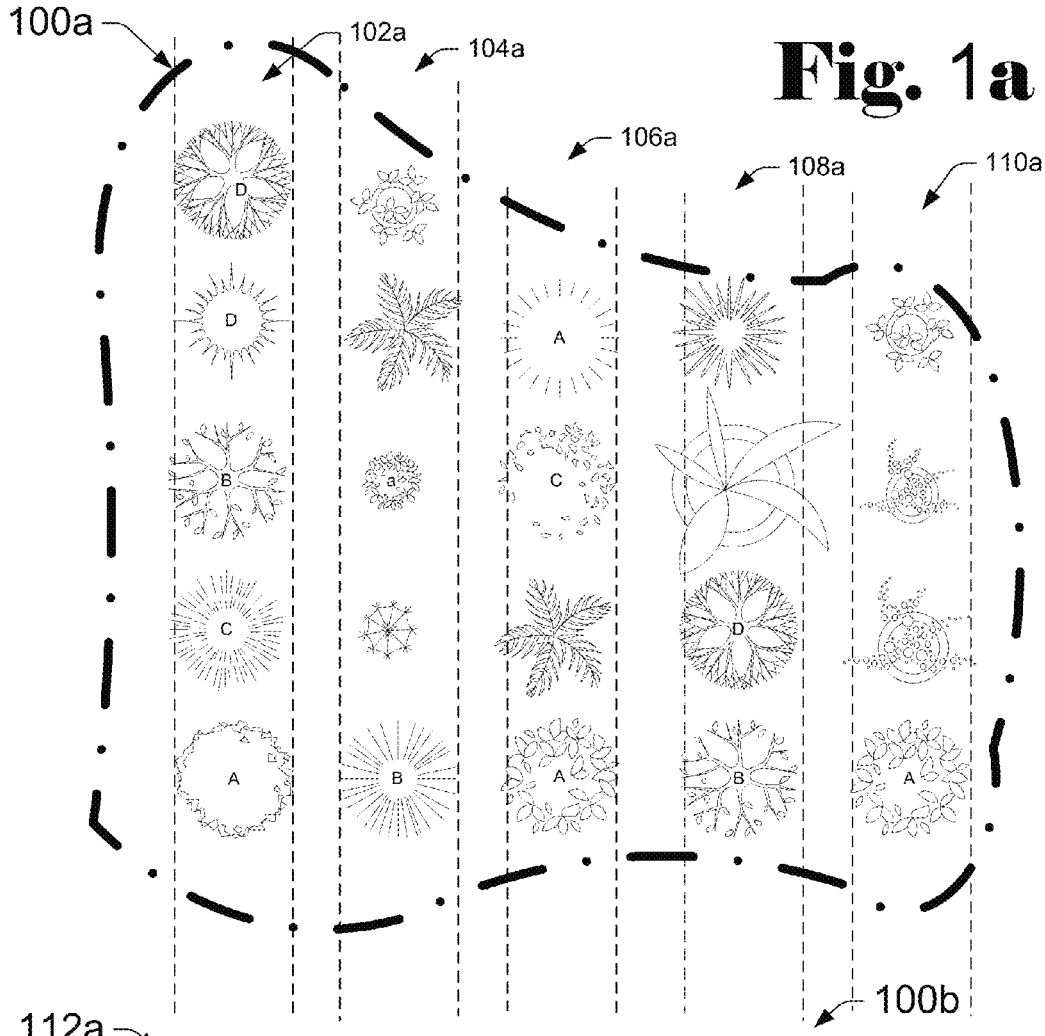
FIG. 1*a* is a top planar view of an exemplary tree orchard having a plurality of different types and kinds of trees.

Referring to FIG. 1*a*, an exemplary tree orchard 100*a* grows a variety of trees in rows 102*a*-110*a*, including deciduous, evergreen, palm, and cactus.

Figure 1B:
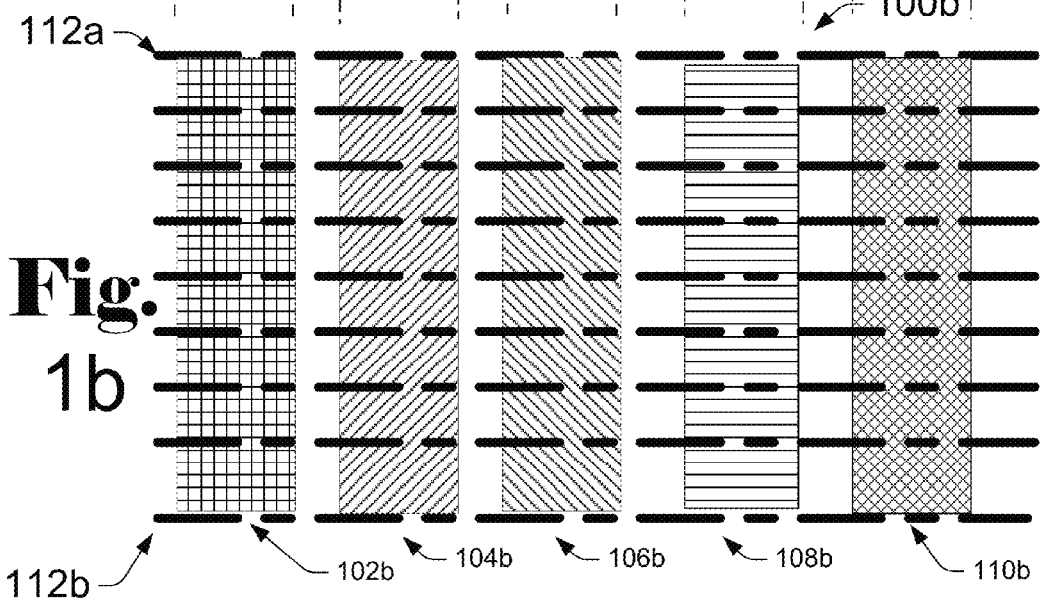
FIG. 1*b* is a front elevational view of the tree orchard seen in FIG. 1*a;*

Referring to FIG. 1*b* at reference numeral 100*b*, each tree in each row 102*b*-110*b* is harvested and cut into separate logs as illustrated by the horizontal segment lines shown between reference numerals 112 and 112*b*.

Figure 2:
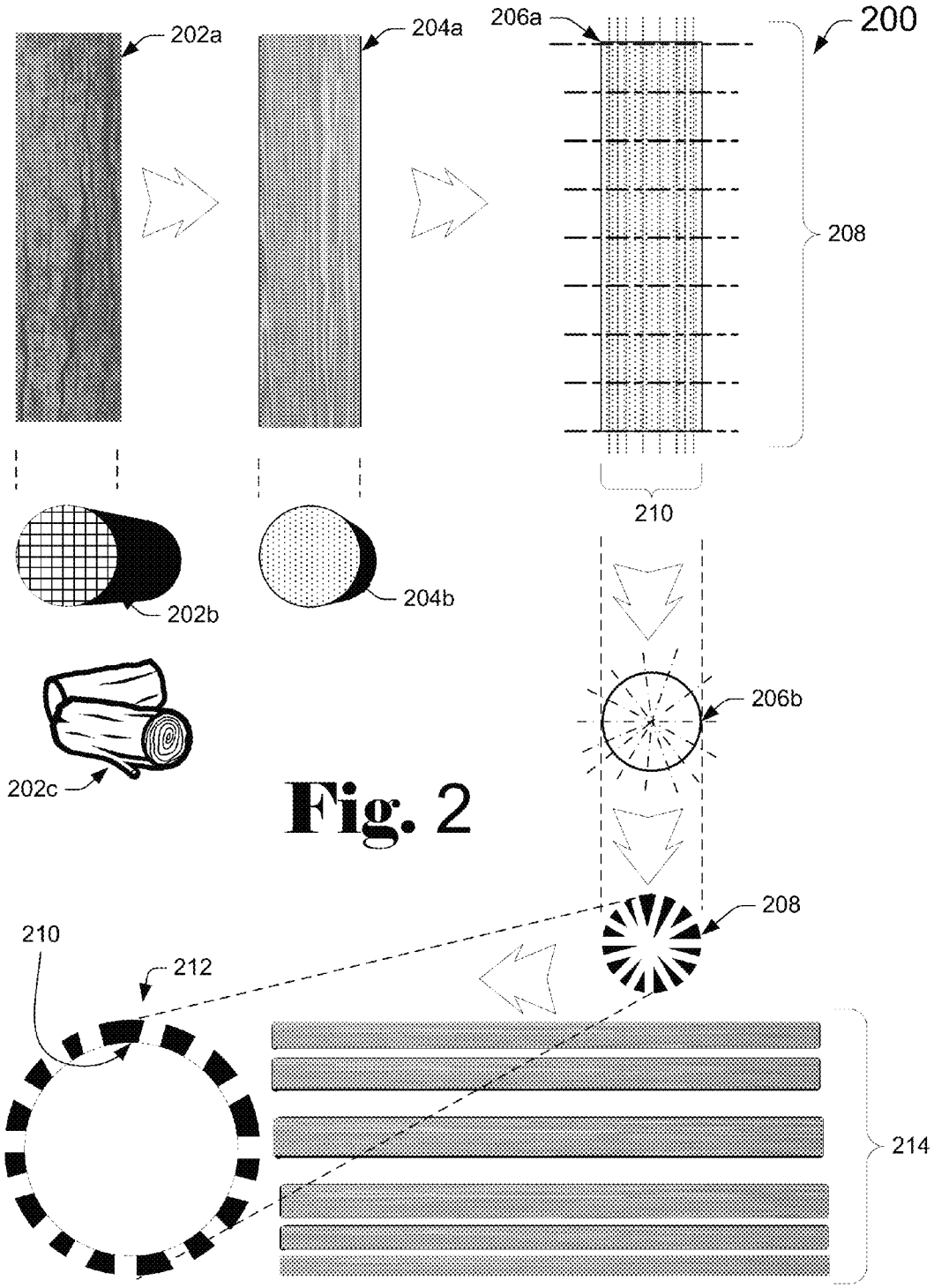
FIG. 2 depicts progressive stages in an exemplary implementation for the processing of a wooden log cut from tree in the tree orchard seen in FIGS. 1*a*-1*b*, resulting in a deconstructed wooden log.

Referring to FIG. 2, logs 202*c* have been cut from one or more of the harvested tree of the orchard seen in FIG. 1*a*. The bark from one such log 202*a*-202*b* is removed to result in debarked log 204*a*-204*b*. The debarked log 204*a*-204*b* is subjected to a plurality of horizontal cuts as shown at reference numeral 208, and to a plurality of vertical cuts as shown at reference numeral 210*a*. The result of horizontal and vertical cuts is a plurality of segments shown at reference numeral 208. Implementations of the cutting process result in the segments, each being substantially pie shaped, shown at reference numeral 208 in a radially disposed arrangement.

Each substantially pie shaped segment, such as are depicted at reference numeral 208, is further hewn to remove the narrowed, inward portion thereof by way of a cutting process illustrated at reference numeral 210. Implementations of this further cutting process result in the segments shown at reference numeral 212 in a radially disposed arrangement. A result of this further cutting process, in some implementations, is seen at reference numeral 214 where a side view of a plurality of segments of varying shapes and sizes are shown. Note that the debarked surface area of some of segments can be larger than that of others, although the length of each segment is preferably about the same. Optionally, each segment shown at reference numeral 214 can subjected to further finishing processes, including but not limited to sanding, staining, varnishing, painting, embossing, inlaying, hot branding, etc.

Referring to FIG. 3*a*, a plurality of segments, each being prepared from one (1) log from one (1) tree by implementations generally described above with respect to FIGS. 1*a* through 2, are radially disposed as shown at reference numeral 302*a*. Adjacent segments preferably will be arranged so as to closing depict the original appearance of the log from which the segments were cut. Each adjacent segment is separated by a spacer, such as are seen at reference numerals 304*b*, 306*b*, 308*b*, 310*b*, and 312*b*. One or more such spacers will preferably be fully or partially transparent.

By way of example, and not by way of limitation, a pilot hole is drilled through each segment in an adjacent pair thereof. A spacer is aligned between entrances to the pilot holes in each of the adjacent segments. A fastener, such as a wood screw, is driven into one segment, through the spacer there between, and into the other adjacent spacer. As such, the fastener secures each segment to the other segment in a spaced apart and parallel orientation. By so securing a plurality of adjacent segments, the original wooden log cut from the tree, as described above, is reconstructed. An exemplary embodiment of a reconstructed wood log is shown in FIG. 3*b* at reference numeral 302*b*. According, adjacent segments are fastened by a fastener and a spacer as shown by seen at reference numerals 304*a*-304*b*, 306*a*-306*b*, 308*a*-308*b*, 310*a*-310*b*, and 312*a*-312*b*. Other implementations, the spacers can have both transparency and adhesive properties in order to avoid the need for fasteners in securing adjacent segments.

Referring to FIG. 4C, a light source 410*b* is shown, the purpose of which is to provide illumination from the interior of reconstructed wooden log 402*a*. Optionally, reconstructed wooden log 402*a* can be formed as a shell, façade, or cladding that covers or conceals a structural element 408*c*, which can be in any of a variety of shapes and sizes such as a tubular structure 408*a* or an elongate channel 408*b*. Other implementations of structural element 408*a* include: (i) a structural post or beam; (ii) a chase for electrical wiring; (ii) an image capture device such as a still or video camera; (iii) an audio rendering device such as a speaker; (iv) duct work such are used for heating, ventilation, and air conditioning; and (v) combinations of the foregoing. In still other implementations, a elongate tubular light source 410*a* can be wound around the structural element 408*a*, 408*b*, 408*c* to provide illumination from the inside of the reconstructed wooden log 402*a*.

In other implementations, various types of lighting, as are used for commercial and residential applications, can include fluorescent light, strobes light, black light, laser light, rope lights, holiday themed lights, flood lights, LED lights, etc. In still further implementations, the reconstructed wooden log 402*a* can be configured with lights that interact with music and other sounds as an alternative variety of a dynamic colorful musical yule log for a Yule, Christmas or winter solstice celebration.

Referring to FIGS. 4*a*-4*c*, one or more of a variety of electro-mechanical devices can be installed in and on a reconstructed wood log 402*a* as shown are reference numeral 402*b*. A transreceiving device, seen at reference numeral 412*a* receives and sends information bearing signals from and to a user operated handheld device 412*b*. In various implementations, information is input by the user to control one or more of the electro-mechanical devices installed in and/or on a reconstructed wood log 402*a*. In addition, information such as sights and sounds captured by cameras and microphones shown at reference numeral 418, or otherwise as are proximate to reconstructed wood log 402*a* and sent to transreceiving device 412*a*, are transmitted to handheld device 412*b*. Also shown are a power source 414 to power any of a variety of electro-mechanical devices, including a rotation motor 406*a*, one or more light sources 410*b*, transreceiving device 412*a*, motion detector 416, and the audio-visual capture and rendering devices seen at reference numeral 418. Optionally, at least of the power from power source 414 can be via solar power functionality. The rotation motor 406*a* is attached so that, upon actuation, the reconstructed wood log 402*a* is axially rotated as shown at reference numeral 406*b*.

End caps 404*a*, 404*b* are secured to opposing end of a reconstructed wood log 402*a*. The closing of the opposing ends of the reconstructed wood log 402*a* with end caps 404*a*, 404*b* enhances the illumination emanating through and around the spacers securing to each adjacent segment, thereby providing an interiorially illuminated reconstructed wooden log.

In a still further implementation, holes can be drilled through the debarked surface of one of more segments. Each such hole can then receive therein an embedded fully or partially transparent object through which light is emitted from one or more light sources inside the reconstructed wood log. The embedded objects can be of a variety of different shapes and sizes, including letters, numbers, and other symbols. As such, the embedded objects can allow the interiorially illuminated reconstructed wooden log to function as illuminated signage. By way of example, and not by way of limitation, embedded objects can include types of designs and embellishments: (i) different styles of lines (wavy, flame-like, etc.)1 (ii) glass beads; (iii) glass tiles; (iv) glass blocks; (v) stained glass; (vi) geodes; (vii) crystals; (vii) masks; (viii) different colors of cellophane, Plexiglas™ and other transparent or translucent materials, and personal items.

Figure 5:
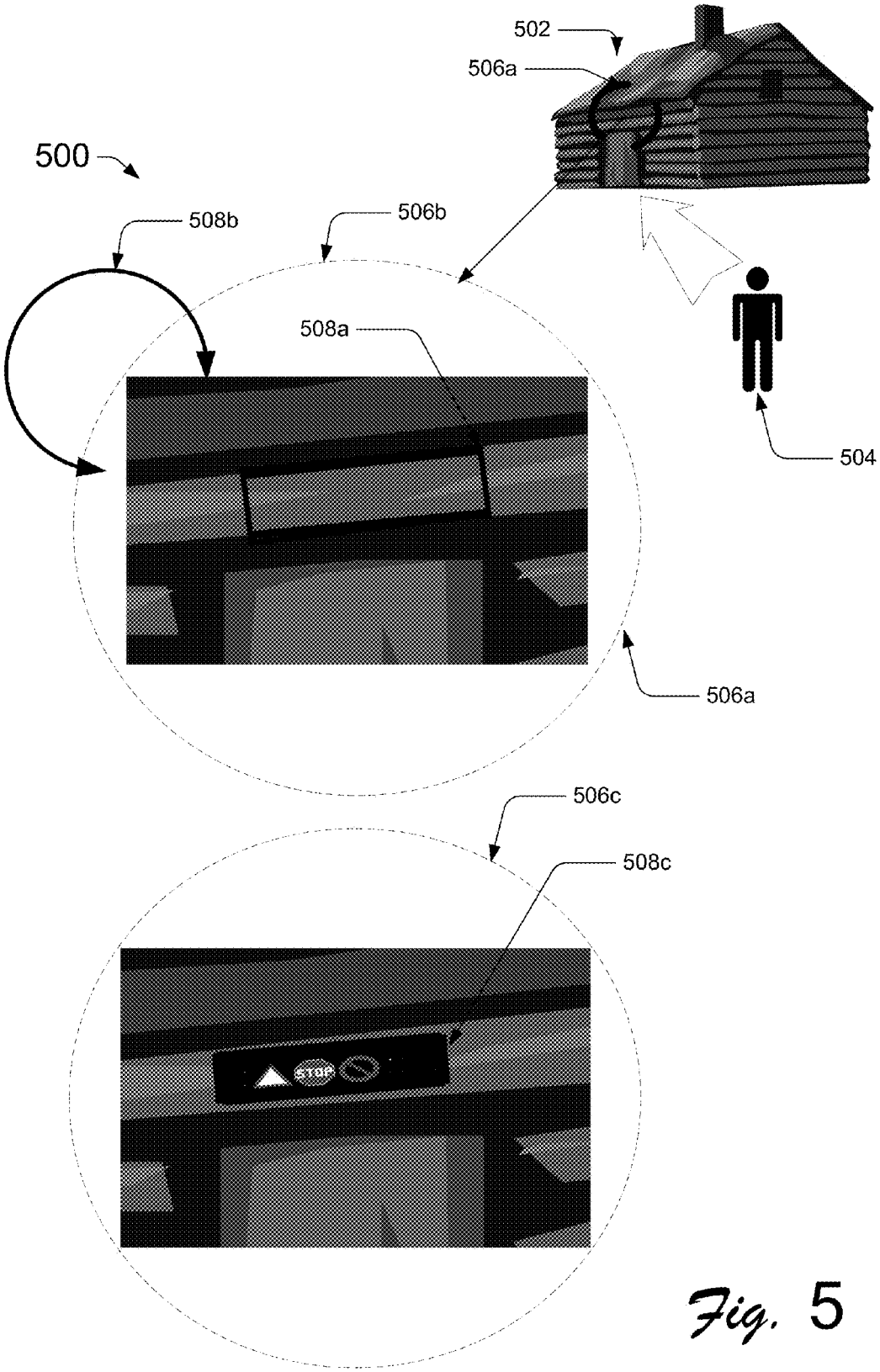
FIG. 5 depicts a log cabin built from a plurality of wooden logs and having a door, the cabin incorporating over the door an interiorially illuminated reconstructed wooden log prepared by an exemplary processing implementation such as is shown in FIGS. 1*a* though 3, the reconstructed wooden log having a plurality of electro-mechanical mechanisms to provide motion detected activated dynamic camouflage audio visual signage.

In one implementation where an interiorially illuminated reconstructed wooden log functions as illuminated signage, FIG. 5 shows a log cabin 502 being approached by a person 504. The interiorially illuminated reconstructed wooden log 508*a*, 508*c*, as shown in cut-way views at reference numerals 506*a*, 506*b*, and 506*c*, is embedded above a door in the log cabin 502. The log 508*a* has an outwardly facing side that does not allow light to be emitted from its interior. The natural wood log appearance of the outwardly facing side of the reconstructed log 508*a* serves as camouflage to the approaching person 504 until a determined proximity. A motion detection sensor inside the reconstructed log 508*a* detects the movement of the approaching person 504 at the determined proximity. Upon such detection, a rotation motor (not shown) is activated by a signal from the motion detection sensor. The activation of the motor causes the reconstructed log 508*a* to rotate in a motion shown are reference numeral 508*b* to reveal a signage bearing surface as shown at reference numeral 508*c*. The signage-bearing surface, which illuminated by one or more light surfaces inside the reconstructed log 508*c*, is clearly visible to the person 504 approaching the log cabin 502. Optionally, an audible file rendered by an transreceiving device can also be emitted from a speaker inside the reconstructed log 508*c* so as to be heard by the person 504 approaching the log cabin 502 (e.g., "NO TRESSPASSING!").

In various implementations given by way of example, and not by way of limitation, the signal from the motion detection sensor can cause an Audio-Visual (AV) capture device inside or proximate to the reconstructed log 508*c* to capture and send AV information about the approaching person 504 via a trans receiver device also inside or proximate to the reconstructed log 508*c*. The transmission is sent to a predetermined logical address of a user for receipt by a web enabled portable computing device (e.g., a smart phone). The user, in response, speaks into the web enabled portable computing device for transmission of the spoken phrase to, and for audible rendering by, the transceiver device inside the reconstructed log 508*c*. As such, the user can remotely speak and listen to the approaching person 504 to whom is displayed the illuminated signage of the reconstructed log 508*c*. Optionally, the appearance of the signage bearing surface of the reconstructed log 508*c* can be configured by mechanisms inside the reconstructed log 508*a* are known in the dynamic signage arts. These appearance changes can include, but are not limited to sight and sound. Both present and future mechanisms pertaining to the dynamic signage arts are contemplated by the present disclosure.

The various steps or acts in a method or process may be performed in the order shown, or may be performed in another order. Additionally, one or more process or method steps may be omitted or one or more process or method steps may be added to the methods and processes. An additional step, block, or action may be added in the beginning, end, or intervening existing elements of the methods and processes. Based on the disclosure and teachings provided herein, a person of ordinary skill in the art will appreciate other ways and/or methods for various implements.

It is understood that the examples and implementations described herein are for illustrative purposes only and that various modifications or changes in light thereof will be suggested to persons skilled in the art and are to be included within the spirit and purview of this application and scope of the appended claims.

What is claimed is:

1. A method for forming a useful article from a wooden tree log, the article having a length substantially equal to that of the longitudinal axis of the wooden tree log, and, the article having a width substantially circular in cross section, the method comprising:

separating the wooden tree log radially about its longitudinal axis into a plurality of segments each having:

a width substantially equal to the radius of the circular cross section of the wooden tree log; and a length substantially equal to the length of the wood tree log;

forming a plurality of modified segments by removing from each said segment a portion thereof that had been proximal to the longitudinal axis of the wooden tree log; and forming, from the modified segments, a modified wooden tree log having:

substantially the same length and width as the wooden tree log;

a substantially cylindrical hollow interior;

adjacent said modified segments attached by a fastener; and a spacer separating each of a plurality of the adjacent said modified segments sufficient size to permit light to pass around each of spacer.

2. The method as defined in claim 1, further comprising removing bark from an external surface of the wooden tree log.

3. The method as defined in claim 1, further comprising applying a treatment to a least a portion of the external surface of one or more of the modified segments, wherein the treatment is selected from the group consisting of sanding, staining, varnishing, painting, embossing, inlaying, hot branding, and a combination of the foregoing.

4. The method as defined in claim 1, wherein each said modified segment has convex opposing ends.

5. The method as defined in claim 1, wherein one or more of the spacers are at least partially transparent.

6. The method as defined in claim 1, wherein one or more of the spacers have at least one said fastener passing there though to attach the corresponding adjacent said modified segments.

7. The method as defined in claim 1, wherein each said spacer has an adhesive property to attach the corresponding adjacent said modified segments.

8. The method as defined in claim 1, wherein one said more said spacers are at least partially transparent to permit light to pass there through.

9. The method as defined in claim 1, wherein forming the modified wooden tree log comprising placing the modified segments respectively in substantially the same sequential order and location prior to being as separated from the wooden tree log.

10. The method as defined in claim 1, wherein separating the wooden tree log comprises, at least in part, a sawing operation.

11. The method as defined in claim 1, wherein separating the wooden tree log comprises, at least in part, a log splitting operation.

12. The method as defined in claim 1, wherein forming the modified wooden tree log further comprises forming the modified segments to encode a structural element selected from the group consisting of a structural beam, a chase for electrical wiring, at least one of a sight and sound capture device, a ventilation duct, and combinations of the foregoing.

13. The method as defined in claim 1, further comprising:

forming a hole through at least one said modified segment; and embedding an object in the hole, wherein:

the object is at least partially transparent to permit light to pass there through; and the object is selected from the group consisting of a glass beads, a glass tile, a glass block, stained glass, a geode, a crystals, a porous structure, a structure having holes there through, cellophane, Plexiglas™, and a combination of the foregoing.

14. The method as defined in claim 1, further comprising at least partially closing at least one of the opposing ends of the modified wooden tree log.

15. The method as defined in claim 1, further comprising providing a light source in the substantially cylindrical hollow interior for emitting light to pass through a plurality of the adjacent said modified segments around the spacers there between.

16. The method as defined in claim 12, wherein the light source is selected from the group consisting of a fluorescent light, a strobe light, a black light, a laser light, a rope light, a flood light, an LED light, and combinations of the foregoing.

17. The method as defined in claim 1, further comprising providing, proximal the substantially cylindrical hollow interior, one or more electro-mechanical devices selected from the group consisting of:

at least one of a sight and sound capture device;

a power source to power any said electro-mechanical device;

a motor to rotate the modified wooden tree log about its longitudinal axis;

a receiver for signal carrying information for controlling at least one of the electro-mechanical devices;

means for transmitting a signal carrying information from at least one of the electro-mechanical devices.

18. An interiorially illuminated reconstructed wooden log tree log comprising:

a plurality of wood segments separated from the same log of tree, each said wood segment having:

a length with opposing concentric convex substantially arcuate ends; and means for securing the wood segment to a pair of adjacent said wood segments and a spacer contacting the wood segment and one of the adjacent said wood segments;

a substantially cylindrical hollow interior defined by the interior opposing concentric convex substantially arcuate ends of the plurality of wood segments; and a light source within the substantially cylindrical hollow interior, whereby light from the light source passes between adjacent said wood segments.

19. A sign comprising:

a plurality of wood segments separated from the same log of a tree, each said wood segment having:

a length with opposing concentric convex substantially arcuate ends; and means for securing the wood segment to a pair of adjacent said wood segments, wherein one of more of the wood segments has at least partially transparent signage embedded therein;

a substantially cylindrical hollow interior defined by the interior opposing concentric convex substantially arcuate ends of the plurality of wood segments;

a light source within the substantially cylindrical hollow interior, whereby light from the light source passes through the at least partially transparent signage;

a sensor to:

detect proximal motion; and transmit, in response to the detected proximal motion, a signal;

a motor, in response to the signal, rotating the plurality of wood segments; and a switch, in response to the signal, to direct power to the light source.

20. The sign as defined in claim 19, wherein the tree is selected from the group consisting of a deciduous tree, an evergreen tree, a palm tree, and a cactus.

* * * * *